US006339937B1

(12) United States Patent
Makihara et al.

(10) Patent No.: US 6,339,937 B1
(45) Date of Patent: Jan. 22, 2002

(54) REFRIGERANT EVAPORATOR

(75) Inventors: Masamichi Makihara, Gamagori; Isao Kuroyanagi, Anjo; Toshiya Nagasawa, Obu; Eiichi Torigoe, Anjo, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/573,241

(22) Filed: May 18, 2000

(30) Foreign Application Priority Data

Jun. 4, 1999 (JP) ..... 11-158424
Jul. 9, 1999 (JP) ..... 11-196346
Mar. 9, 2000 (JP) ..... 12-071059

(51) Int. Cl.[7] ..... F25B 43/00
(52) U.S. Cl. ..... 62/503
(58) Field of Search ..... 62/503, 408, 513, 62/523, 515; 165/172, 173, 174, 745, 176

(56) References Cited

U.S. PATENT DOCUMENTS 4,738,311 A * 4/1988 Bleckman ..... 165/165
4,745,967 A * 5/1988 Kern ..... 165/150
5,190,101 A * 3/1993 Jalilevand et al. ..... 165/176
5,479,985 A * 1/1996 Yamamoto et al. ..... 165/176
5,744,255 A * 4/1998 Doko et al. ..... 428/654
5,941,303 A * 8/1999 Gowan ..... 165/176
5,992,514 A * 11/1999 Sugimoto et al. ..... 165/135
6,209,202 B1 * 4/2001 Rhodes et al. ..... 29/890.053
6,216,776 B1 * 4/2001 Kobayashi et al. ..... 165/173

FOREIGN PATENT DOCUMENTS

JP A-11-287587 10/1999

* cited by examiner

*Primary Examiner*—Sang Paik
*Assistant Examiner*—Danmiel Rodinson
(74) *Attorney, Agent, or Firm*—Harness, Dickey & Pierce, PLC

(57) ABSTRACT

In a refrigerant evaporator, plural tubes made of aluminum are arranged in a laminating direction perpendicular to an air flowing direction, and plural corrugated fins made of aluminum are disposed between adjacent tubes. In the evaporator, when a tube plate thickness TT of the tubes is set in a range of 0.10 mm–0.35 mm and a tube height TH of each tube in the laminating direction is set in a range of 1.5 mm–3.0 mm, pressure loss of refrigerant in a refrigerant passage becomes smaller, and a heat-conductive area of air becomes larger. Further, when a fin height FH of the corrugated fins is set in a range of 4.0–7.5 mm, fin effect of the corrugated fins is improved. As a result, heat-conductive performance of the evaporator is improved.

20 Claims, 9 Drawing Sheets

REFRIGERANT EVAPORATOR

CROSS-REFERENCE TO RELATED APPLICATION

This application is related to and claims priority from Japanese Patent Applications No. Hei. 11-158424 filed on Jun. 4, 1999, No. Hei. 11-196346 filed on Jul. 9, 1999, and No. 2000-71059 filed on Mar. 9, 2000, the contents of which are hereby incorporated by reference.

BACKGROUND OF THE INVENTION

1. Field of the Invention

The present invention relates to a refrigerant evaporator for evaporating refrigerant of a refrigerant cycle, which is suitable for a vehicle air conditioner.

2. Related Art

In a conventional refrigerant evaporator, plural aluminum tubes having therein refrigerant passages are laminated, and plural corrugated fins made of aluminum are disposed between adjacent tubes to increase heat conductive area of air. For reducing the weight of the evaporator, a tube plate thickness is thinned until 0.4 mm. However, the relationship between the thinned tube plate thickness and the heat-conductive performance of the evaporator is not described sufficiently.

SUMMARY OF THE INVENTION

In view of the foregoing problems, it is an object of the present invention to provide a refrigerant evaporator having a sufficiently thinned tube plate thickness, in which conditions for obtaining the maximum heat-conductive performance are found so that the heat-conductive performance of the evaporator is improved.

It is an another object of the present invention to provide a refrigerant evaporator in which the heat-conductive performance is improved while pressure-resistance strength of tubes is improved.

According to a first aspect of the present invention, a refrigerant evaporator includes a plurality of tubes through which refrigerant flows, and a plurality of corrugated fins, made of an aluminum material, each of which is disposed between adjacent tubes to increase a heat-conductive area of air passing through between the tubes. The tubes are made of an aluminum material and are arranged in parallel with each other in a laminating direction perpendicular to a flow direction of air. In the evaporator, the tubes have a tube plate thickness TT being in a range of 0.10 mm–0.35 mm, each of the tubes has a tube height TH in the laminating direction, and the tube height TH is in a range of 1.5 mm–3.0 mm. Thus, by respectively setting the tube plate thickness TT and the tube height TH in the above-described ranges, pressure loss of refrigerant in a refrigerant passage of the tubes is made small, and heat-conductive area of air side becomes larger. As a result, heat-conductive performance of the evaporator is improved.

According to a second aspect of the present invention, in a refrigerant evaporator, each of the corrugated fins has a fin height FH in the laminating direction, and the fin height FH is in a range of 4.0 mm–7.5 mm. Therefore, in the evaporator, fin effect of the corrugated fins can be increased, and a decrease of heat-conductive percentage due to condensed water restricted. As a result, the heat-conductive percentage of the evaporator is improved.

In a refrigerant evaporator where each of the tubes is formed to have an outer wall portion formed into a flat cross section for defining therein an inner space and to have plural supports for partitioning the inner space of the outer wall portion into plural refrigerant passages, the outer wall portion has a plate thickness being in a range of 0.15 mm–0.35 mm, each of the tubes has a tube height TH being in a range of 1.5 mm–3.0 mm in the laminating direction, each of the supports has a plate thickness ST equal to or larger than 0.05 mm, and a distance L between adjacent supports is in a range of 0.8 mm–1.6 mm. By setting the distance L between adjacent supports at a value equal to or larger than 0.8 mm while the tube plate thickness TT and the tube height TH are respectively set in the above-described ranges, the pressure loss of refrigerant in the refrigerant passage of the tubes becomes smaller, heat-conductive area of air becomes larger, and heat-conductive performance is improved. Further, in the evaporator, by setting the plate thickness ST of the supports at a value equal to or larger than 0.05 mm and setting the distance L between adjacent supports at a value equal to or smaller than 1.6 mm, pressure-resistance strength of the tubes is improved, and heat-conductive percentage is improved.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PREFERRED EMBODIMENTS

Preferred embodiments of the present invention are described hereinafter with reference to the accompanying drawings.

A first preferred embodiment of the present invention will be described with reference to FIGS. 1–10. In the first embodiment, the present invention is typically applied to a refrigerant evaporator 1 of a refrigerant cycle for a vehicle air conditioner. The evaporator 1 is disposed in a unit case of a vehicle air conditioner (not shown) to correspond to the arrangement of FIG. 1 in an up-down direction. When air is blown by a blower (not shown) and passes through the evaporator 1 in an air flowing direction A in FIG. 1, heat exchange is performed between blown-air and refrigerant flowing through the evaporator 1.

The evaporator 1 has plural tubes 2–5 through which refrigerant flows in a longitudinal direction of the tubes 2–5. The tubes 2–5 are arranged in parallel with each other in a width direction perpendicular to both of the air flowing direction A and the longitudinal direction of the tubes 2–5. Further, the tubes 2–5 are arranged in two rows disposed adjacent to each other in the air flowing direction A. That is, the tubes 2, 3 are arranged at a downstream air side, and the tubes 4, 5 are arranged at an upstream air side of the tubes 2, 3. Each of the tubes 2–5 is a flat tube forming a refrigerant passage with a flat cross-section therein. The tubes 2, 3 define a refrigerant passage of an inlet-side heat exchange portion X, and the tubes 4, 5 define a refrigerant passage of an outlet-side heat exchange portion Y.

Figure 1:
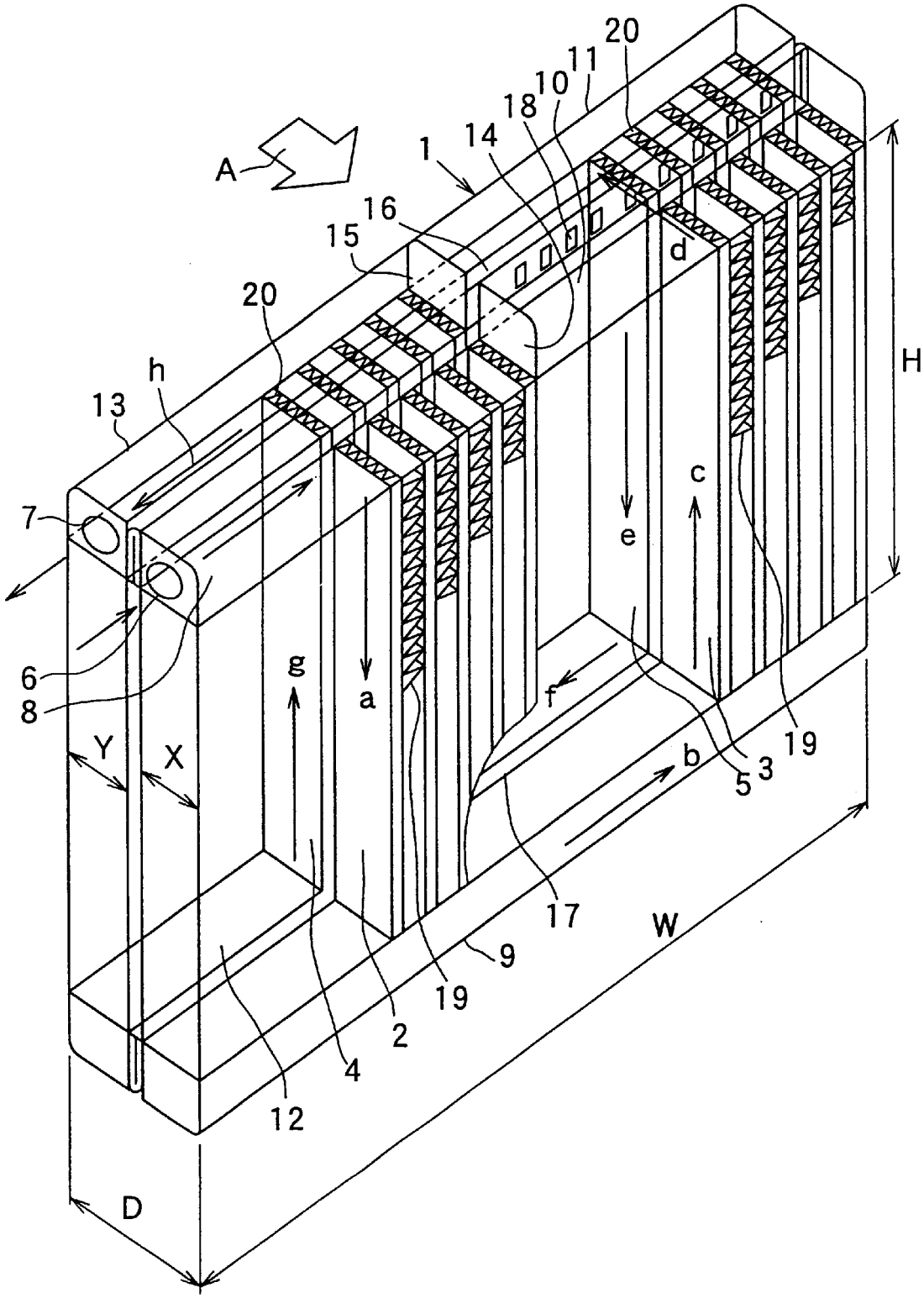
FIG. 1 is a schematic perspective view showing a refrigerant evaporator according to a first preferred embodiment of the present invention.

In FIG. 1, the tubes 2 are disposed at a left side of the inlet-side heat exchange portion X, and the tubes 3 are disposed at a right side of the inlet-side heat exchange portion X. Similarly, the tubes 4 are disposed at a left side of the outlet-side heat exchange portion Y, and the tubes 5 are disposed at a right side of the outlet-side heat exchange portion Y.

The evaporator 1 has an inlet 6 for introducing refrigerant and an outlet 7 for discharging refrigerant. Low-temperature and low-pressure gas-liquid two-phase refrigerant decompressed by a thermal expansion valve (not shown) of the refrigerant cycle is introduced into the evaporator 1 through the inlet 6. The outlet 7 is connected to an inlet pipe of a compressor (not shown) of the refrigerant cycle so that gas refrigerant evaporated in the evaporator 1 is returned to the compressor through the outlet 7. In the first embodiment, the inlet 6 and the outlet 7 are disposed on an upper left end surface of the evaporator 1.

The evaporator 1 has an upper left inlet-side tank portion 8 disposed at an upper left inlet side, a lower inlet-side tank portion 9 disposed at a lower inlet side, an upper right inlet-side tank portion 10 disposed at an upper right inlet side, an upper right outlet-side tank portion 11 disposed in an upper right outlet side of the evaporator 1, a lower outlet-side tank portion 12 disposed at a lower outlet-side, and an upper left outlet-side tank portion 13 disposed at an upper left outlet side. The inlet 6 communicates with the upper left inlet-side tank portion 8, and the outlet 7 communicates with the upper left outlet-side tank portion 13. Refrigerant is distributed from the tank portions 8–13 into each of the tubes 2–5 and is collected from each of the tubes 2–5 into the tank portions 8–13. The tank portions 8–13 are also arranged in two rows adjacent to each other in the air flowing direction A, corresponding to the arrangement of the tubes 2–5. That is, the inlet-side tank portions 8–10 are disposed on the downstream air side of the outlet-side tank portions 11–13.

The upper inlet-side tank portions 8, 10 are defined by a partition plate 14 disposed therebetween, and the upper outlet-side tank portions 11, 13 are defined by a partition plate 15 disposed therebetween. The lower inlet-side tank portion 9 and the lower outlet-side tank portion 12 are not partitioned, and extend along an entire width of the evaporator 1 in the width direction.

In the inlet-side heat exchange portion X of the evaporator 1, each upper end of the tubes 2 communicates with the upper left inlet-side tank portion 8, and each lower end of the tubes 2 communicates with the lower inlet-side tank portion 9. Similarly, each upper end of the tubes 3 communicates with the upper right inlet-side tank portion 10, and each lower end of the tubes 3 communicates with the lower inlet-side tank portion 9. In the outlet-side heat exchange portion Y of the evaporator 1, each upper end of the tubes 4 communicates with the upper left outlet-side tank portion 13, and each lower end of the tubes 4 communicates with the lower outlet-side tank portion 12. Similarly, each upper end of the tubes 5 communicates with the upper right outlet-side tank portion 11 and each lower end of the tubes 5 communicates with the lower outlet-side tank portion 12.

A partition wall 16 is formed between the upper left inlet-side tank portion 8 and the upper left outlet-side tank portion 13, and between the upper right inlet-side tank portion 10 and the upper right outlet-side tank portion 11. That is, the partition wall 16 extends in the all width of the evaporator 1 in the width direction. A partition wall 17 is also formed between the lower inlet-side tank portion 9 and the lower outlet-side tank portion 12 to extend in the all width of the evaporator 1 in the width direction. The partition walls 16, 17 are integrally formed with the tank portions 8–13.

In the first embodiment of the present invention, a right-side portion of the partition wall 16 partitioning the tank portions 10, 11 in FIG. 1 has plural bypass holes 18 through which the tank portions 10, 11 communicate with each other. In the first embodiment, the bypass holes 18 are formed to respectively correspond to the tubes 3, 5, so that refrigerant is uniformly distributed into the tubes 3, 5. That is, the number of the bypass holes 18 is the same as the number of each of the tubes 3, 5.

The bypass holes 18 are simultaneously stamped on the partition wall 16 made of a metal thin plate (e.g., aluminum thin plate) through pressing or the like. In the first embodiment, each of the bypass holes 18 is formed into a rectangular shape. Opening areas of the bypass holes 18 and arrangement positions of the bypass holes 18 are determined so that most appropriate distribution of refrigerant flowing into the tubes 3, 5 is obtained.

Plural wave-shaped corrugated fins 19 are disposed between adjacent tubes 2–5, and are integrally connected to flat outer surfaces of the tubes 2–5. Further, plural wave-shaped inner fins 20 are disposed inside each of the tubes 2–5. Each wave peak portion of the inner fins 20 is bonded to each inner surface of the tubes 2–5. Due to the inner fins 20, the tubes 2–5 are reinforced and a heat conduction area for refrigerant is increased, thereby improving cooling performance of the evaporator 1. The tubes 2–5, the corrugated fins 19 and the inner fins 20 are integrally brazed to form the heat exchange portions X, Y of the evaporator 1. In the first embodiment, the evaporator 1 is assembled by integrally connecting each of parts through brazing.

Each of the tubes 2–5 is formed by bending an aluminum thin plate at a center to define a refrigerant passage having a flat sectional shape. Each inner refrigerant passage of the tubes 2–5 is partitioned into plural small passages by inner fins 20 provided inside the tubes 2–5. The inner surfaces of the tubes 2–5 and each of the wave peak portions of the inner fins 20 are bonded so that the plural small passages extending in the longitudinal direction of the tubes 2–5 are partitioned in each inner refrigerant passage of the tubes 2–5.

The aluminum thin plate for forming the tubes 2–5 may be an aluminum plate, i.e., an aluminum core plate (e.g., A3000) applied with sacrifice corrosion material (e.g., Al-1.5 wt % Zn) on one side surface thereof, for example. In this case, the aluminum plate is disposed so that the surface applied with the sacrifice corrosion material is disposed outside the tubes 2–5. Since the tubes 2–5 are reinforced by the inner fins 20 and are made of a high corrosion-resistance material, thickness TT (tube plate thickness TT) of the aluminum thin plate for forming the tubes 2–5 can be greatly decreased. The inner fins 20 are also made of an aluminum plate (e.g., A3000).

The connection between the inner surface of the tube thin plate of the tubes 2–5 and the inner fin 20 can be simultaneously performed when the evaporator 1 is integrally brazed. That is, when the tube thin plate of the tubes 2–5 is an one-side clad aluminum plate clad with brazing material on one side surface thereof to be disposed inside the tubes 2–5, brazing material does not need to be applied to the tube thin plate. Alternatively, each of the inner fins 20 may be made of a both-side clad aluminum plate clad with brazing material on both side surfaces thereof. In this case, application of brazing material to the wave peak portions of the inner fin 20 is not needed.

In the first embodiment, each of end portions of the tubes 2–5 in the tube longitudinal direction is connected to the tank portions 8–13 by inserting the end portions of the tubes 2–5 into tube insertion holes formed in each flat surface of the tank portions 8–13. When the tank portions 8–13 are formed by both-side clad aluminum plate clad with a brazing material on both side surfaces thereof, the connection of the tubes 2–5 and the tank portions 8–13 is readily performed during a brazing step of the evaporator 1.

Next, operation of the evaporator 1 according to the first embodiment of the present invention will be described. As shown in FIG. 1, first, low-temperature and low-pressure gas-liquid two-phase refrigerant decompressed by the expansion valve (not shown) of the refrigerant cycle is introduced into the upper left inlet-side tank portion 8 from the inlet 6, and is distributed into the tubes 2 to flow downwardly through the tubes 2 as shown by arrow "a". Then, refrigerant flows through the lower inlet-side tank portion 9 rightwardly as shown by arrow "b", and is distributed into the tubes 3 to flow upwardly through the tubes 3 as shown by arrow "c". Refrigerant flows into the upper right inlet-side tank portion 10, passes through the bypass holes 18 as shown by arrow "d", and flows into the upper right outlet-side tank portion 11. Thus, refrigerant moves from the downstream air side to the upstream air side in the evaporator 1 through the bypass holes 18. Thereafter, refrigerant is distributed into the tubes 5 from the upper right outlet-side tank portion 11, flows downwardly through the tubes 5 as shown by arrow "e", and flows into a right-side portion of the lower outlet-side tank portion 12.

Further, refrigerant flows leftwardly as shown by arrow "f" through the lower outlet-side tank portion 12, is distributed into the tubes 4, and flow upwardly through the tubes 4 as shown by arrow "g". Thereafter, refrigerant is collected into the upper left outlet-side tank portion 13, flows leftwardly as shown by arrow "h" through the tank portion 13, and is discharged from the outlet 7 to the outside of the evaporator 1.

On the other hand, air is blown in the air flowing direction A toward the evaporator 1 and passes through openings between the tubes 2–5 and the corrugated fins 19 of the heat exchange portions X, Y of the evaporator 1. At this time, refrigerant flowing through the tubes 2–5 absorbs heat from air and is evaporated. As a result, air is cooled, and is blown into a passenger compartment of the vehicle to cool the passenger compartment.

According to the first embodiment, the inlet-side heat exchange portion X including a zigzag-routed inlet-side refrigerant passage indicated by arrows "a"–"c" in FIG. 1 is disposed on the downstream air side of the outlet-side heat exchange portion Y including a zigzag-routed outlet-side refrigerant passage indicated by arrows "e"–"h" in FIG. 1. Therefore, the evaporator 1 can effectively perform heat exchange with excellent heat conductivity.

Figure 2:
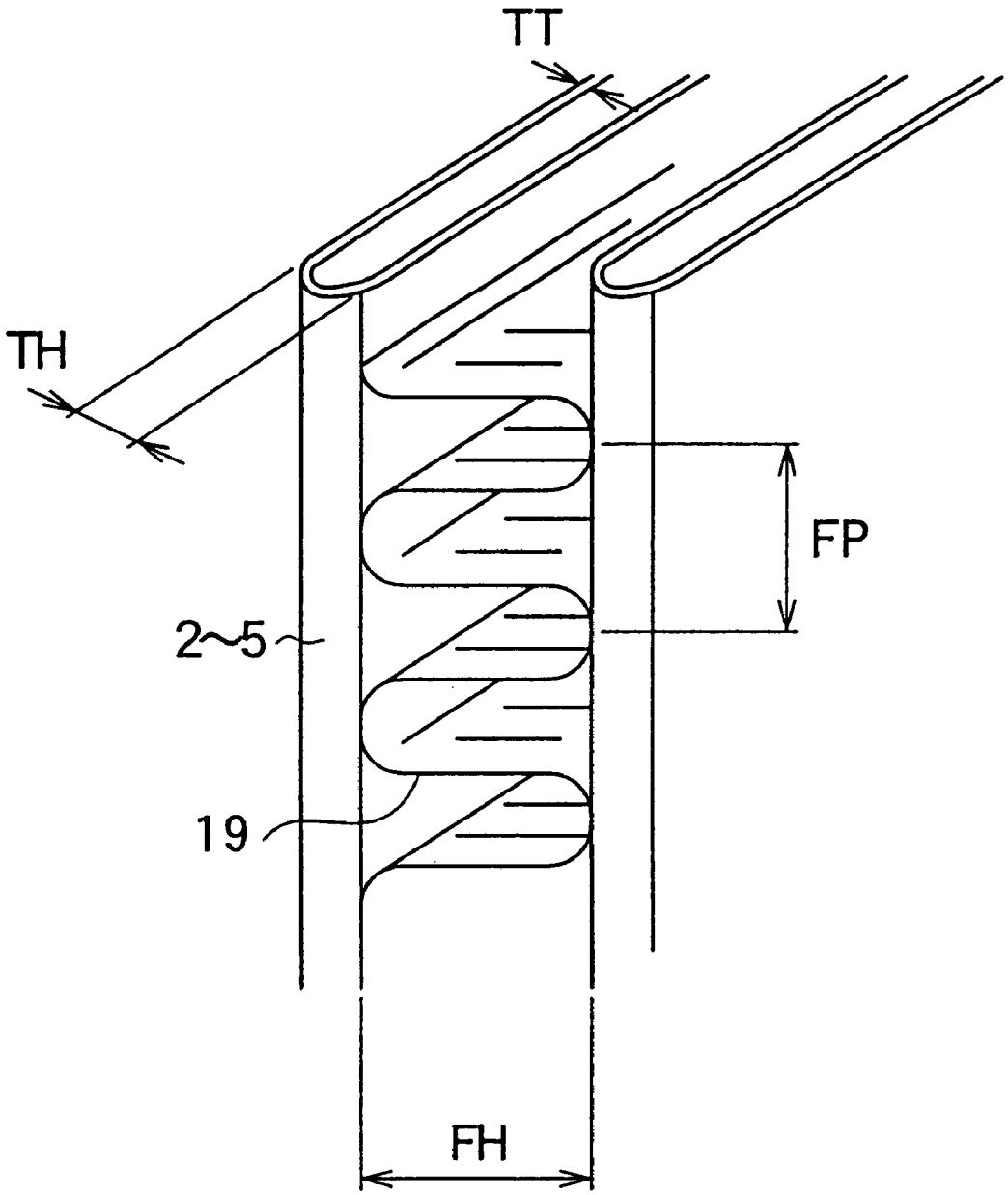
FIG. 2 is an enlarged perspective view of tubes and corrugated fins of the evaporator according to the first embodiment.

In the first embodiment of the present invention, computer simulation relative to a heat-conductive amount Q (W) of the evaporator 1 is performed in the evaporator 1 having the above-described structure. That is, in the simulation, the heat-conductive amount Q (W) of the evaporator 1 is calculated based on a core thickness D, a tube height TH, a tube plate thickness TT, a fin height FH and a fin pitch FP shown in FIGS. 1 and 2. As shown in FIG. 2, the tube height TH is a tube dimension in a laminating direction of each tube 2–5. Further, the fin height FH is a dimension of each corrugated fin 19 in the tube laminating direction.

In the first embodiment, as simulation conditions, a core height H is set at 215 mm (i.e., H=215 mm), a core width W is set at 300 mm (i.e., W=300 mm), a fin plate thickness FT is set at 0.07 mm (i.e., FT=0.07 mm), and passage number is set at 4 (i.e., pass number=4). In the first embodiment, one passage indicates a refrigerant flow in which refrigerant distributed from a tank portion into plural tubes is collected to a tank portion after passing through the plural tubes. For example, in the evaporator 1 of FIG. 1, the refrigerant flow from the tank portion 8 to the tank portion 9 through the tubes 2 is the one passage. Therefore, the evaporator 1 shown in FIG. 1 has 4 passages.

Further, the temperature, the humidity and the amount of air flowing into the core portion of the evaporator 1 are set at constant values, and the temperature and the pressure of refrigerant flowing into the inlet 6 of the evaporator 1 is set at constant values. In the evaporator 1, because the heat-conductive percentage is greatly relative to adhesion of condensed water on the corrugated fins 19, the heat-conductive amount Q is calculated to be relative to the condensed water.

Next, the following variable elements relative to the heat-conductive amount Q of the evaporator 1 will be now described.

(1) FIN HEIGHT (FH)

Figure 3:
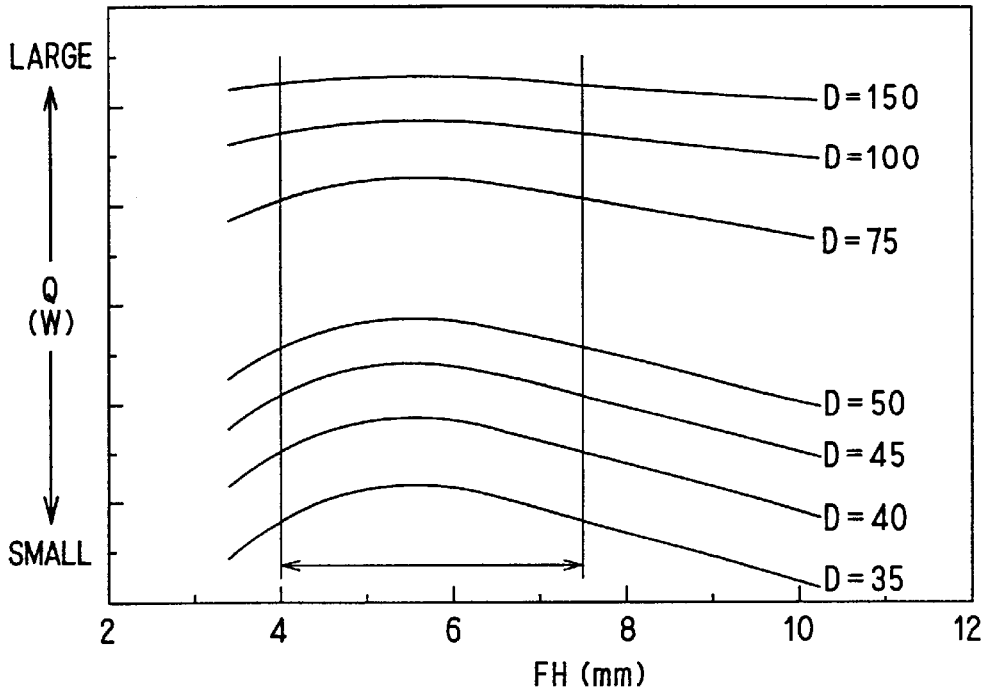
FIG. 3 is a characteristic view showing the relationship between a core thickness D, a fin height FH and a heat-conductive amount Q, according to the first embodiment.

FIGS. 3–6 indicate the relationship between the fin height FH and the heat-conductive amount W. First, in FIG. 3, the tube height TH is set at 1.7 mm (i.e., TH=1.7 mm), the tube plate thickness TT is set at 0.25 mm (i.e., TT=0.25 mm), and a fin pitch FP is set at 3.0 mm (i.e., FP=3.0 mm). In this condition[s], the core thickness D is set at seven different values in a range of 35–150 mm as shown in FIG. 3, and the heat-conductive amount (W) of the evaporator 1 is calculated. A shown in FIG. 3, regardless of the dimension of each core thickness D, when the fin height FH is set in a range of 4.0 mm–7.5 mm (i.e., 4.0 MM≦FH≦7.5 mm), the heat-conductive amount Q becomes larger. Further, when the fin height FH is set in a range of 4.5 mm–6.5 mm (i.e., 4.5 mm≦FH≦6.5 mm), the heat-conductive amount Q further becomes larger. In FIG. 3, when the core thickness D is set at a value equal to or smaller than 50 mm. suitable selection effect of the fin height FH in the range of 4.0 mm–7.5 mm is further improved.

Figure 4:
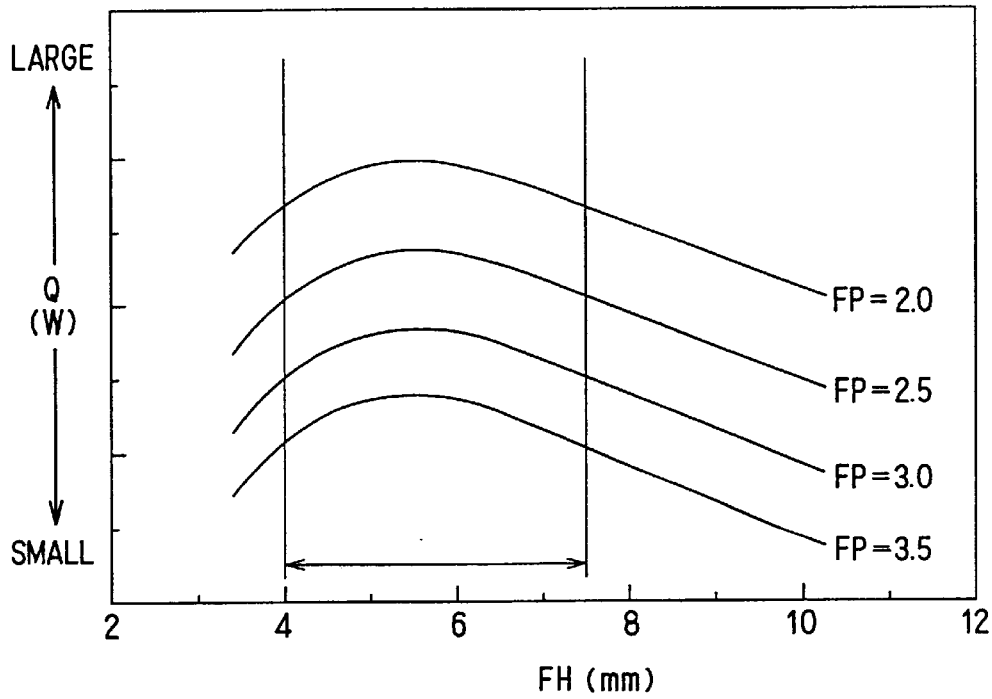
FIG. 4 is a characteristic view showing the relationship between a fin pitch FP, the fin height FH and the heat-conductive amount Q, according to the first embodiment.

In FIG. 4, the tube height TH is set at 1.7 mm (i.e., TH=1.7 mm), the tube plate thickness TT is set at 0.25 mm (i.e., TT=0.25 mm), and the core thickness D is set at 40 mm (i.e., D=40 mm). In this condition, the fin pitch FP is set at four different values in a range of 2.0–3.5 mm as shown in FIG. 4, and the heat-conductive amount Q(W) of the evaporator 1 is calculated. As shown in FIG. 4, regardless of the dimension of each fin pitch FP, when the fin height FH is set in a range of 4.0 mm–7.5 mm (i.e., 4.0 mm≦FH≦7.5 mm), the heat-conductive amount Q becomes larger. Further, when the fin height FH is set in a range of 4.5 mm–6.5 mm (i.e., 4.5 mm≦FH≦6.5 mm), the heat conductive amount Q further becomes larger.

Figure 5:
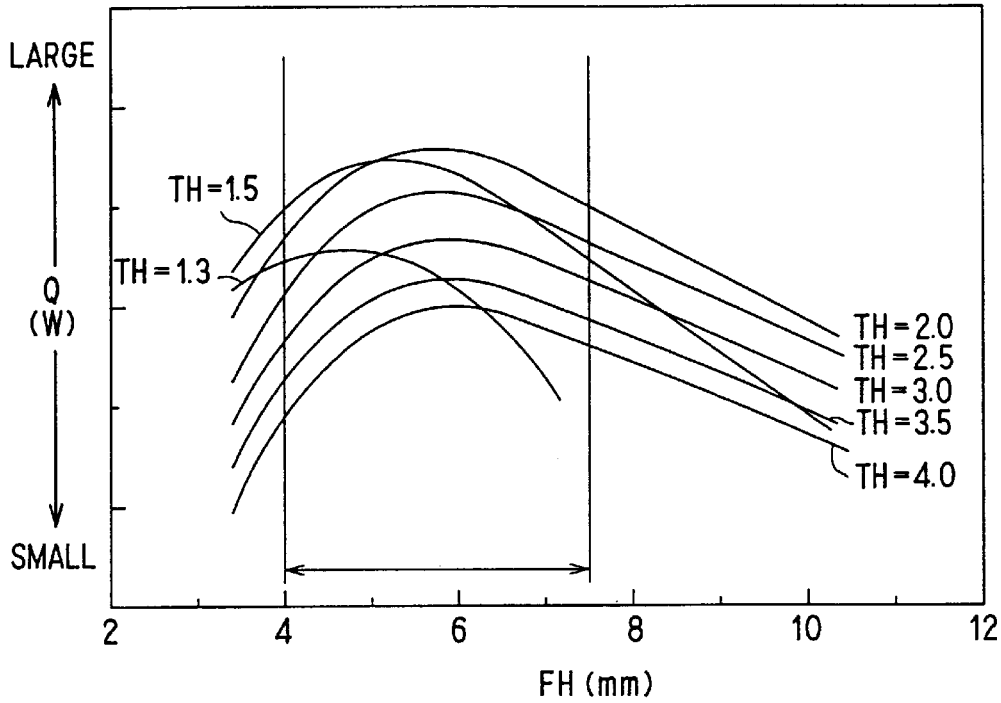
FIG. 5 is a characteristic view showing the relationship between a tube height TH, the fin height FH and the heat-conductive amount Q, according to the first embodiment.

In FIG. 5, the tube plate thickness TT is set at 0.25 mm (i.e., TT=0.25 mm), the fin pitch FP is set at 3.0 mm (i.e., FP=3.0 mm) and the core thickness D is set at 40 mm (i.e., D=40 mm). In this condition, the tube height TH is set at seven different values in a range of 1.3–4.0 mm as shown in FIG. 5, and the heat-conductive amount (W) is calculated. As shown in FIG. 5, when the tube height TH is set larger than 1.5 mm when the fin height FH is set in a range of 4.0 mm–7.5 mm (i.e., 4.0 mm≦FH≦7.5 mm), the heat-conductive amount Q becomes larger. Further, when the fin height FH is set in a range of 4.5 mm–6.5 mm (i.e., 4.5 mm≦FH≦6.5 mm), the heat-conductive amount Q further becomes larger.

(2) TUBE PLATE THICKNESS (TT)

Figure 6:
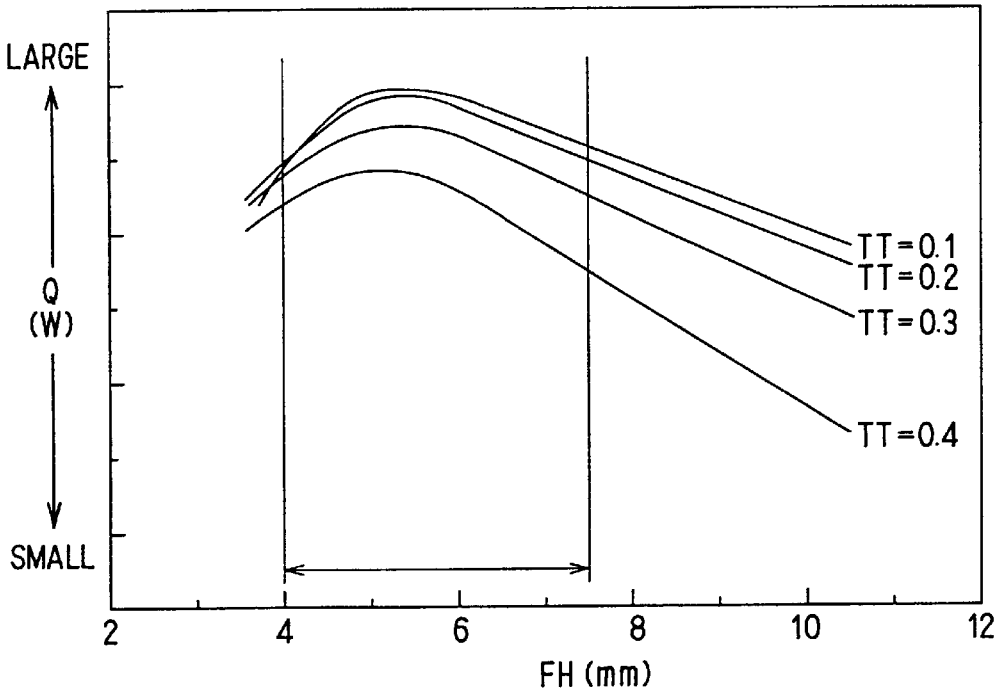
FIG. 6 is a characteristic view showing the relationship between a tube plate thickness TT, the fin height FH and the heat-conductive amount Q, according to the first embodiment.

In FIG. 6, the tube height TH is set at 1.7 mm (i.e., TH=1.7 mm),the fin pitch FP is set at 3.0 mm (i.e., FP=3.0 mm), and the core thickness D is set at 40 mm (i.e., D=40 mm). In this condition, the tube thickness TT is set at four different values in a range of 0.10–0.40 mm as shown in FIG. 6, and the heat-conductive amount (W) is calculated. As shown in FIG. 6, regardless of the dimension of each tube thickness TT, when the fin height FH is set in a range of 4.0 mm–7.5 mm (i.e., 4.0 mm≦FH≦7.5 mm), the heat-conductive amount Q becomes larger. Further, when the fin height FH is set in a range of 4.5 mm–6.5 mm (i.e., 4.5 mm≦FH≦6.5 mm), the heat-conductive amount Q further becomes larger.

In FIGS. 3–6, when the fin height FH is set at a value in a range of 4.0 mm–7.5 mm (i.e., 4.0 mm≦FH≦7.5 mm), the fin effect can be made higher while a decrease of heat-conductive percentage due to condensed water adhered on the corrugated fins 19 is prevented. As a result, the heat-conductive amount Q of the evaporator 1 becomes larger. On the other hand, when FH<4.0 mm, an adhesion area of the corrugated fins 19, on which condensed water is adhered, becomes larger, and therefore, the heat-conductive percentage is decreased. Further, when FH>7.5 mm, the fin effect is decreased, and the heat-conductive percentage is decreased.

Figure 7:
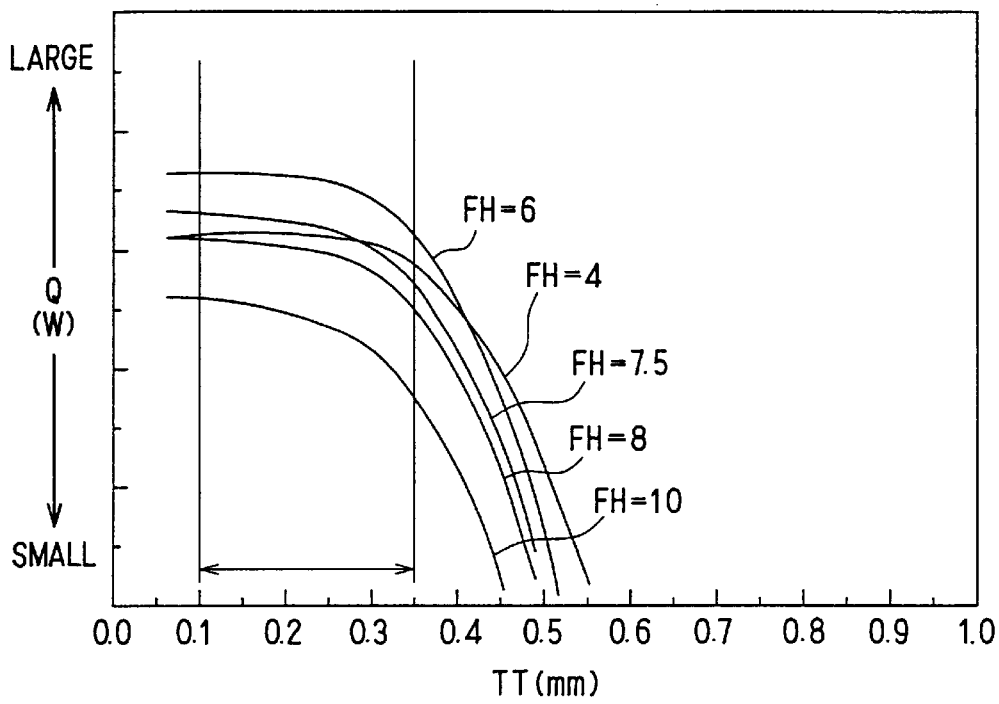
FIG. 7 is a characteristic view showing the relationship between the fin height FH, the tube plate thickness TT and the heat-conductive amount Q, according to the first embodiment.

FIG. 7 shows the relationship between the tube plate thickness TT and the heat-conductive amount Q. In FIG. 7, the tube height TH is set at 1.7 mm (i.e., TH=1.7 mm), the fin pitch FP is set at 3.0 mm (i.e., FP=3.0 mm), and the core thickness D is set at 40 mm (i.e., D=40 mm). In this conditions, the fin height FH is set at five different values in a range of 4–10 mm as shown in FIG. 7, and the heat-conductive amount Q(W) is calculated. As shown in FIG. 7, when the dimension of the tube thickness TT is larger than 0.35 mm, the heat-conductive amount Q is rapidly decreased. When the dimension of the tube thickness TT is larger than 0.35 mm, a sectional area of refrigerant passage within the tubes is relatively reduced, and pressure loss of refrigerant in the refrigerant passage is increased. Therefore, the tube thickness TT is set at a value equal to or smaller than 0.35 mm, for improving the heat-conductive amount Q. On the other hand, the lowest value of the tube plate thickness TT is set through a corrosion test due to condensed water. When an aluminum plate having a sacrifice corrosion layer is used, the lowest value of the tube plate thickness TT can be set at 0.10 mm. That is, in this condition, the tube plate thickness TT can be thinned to 0.1 mm.

Figure 10:
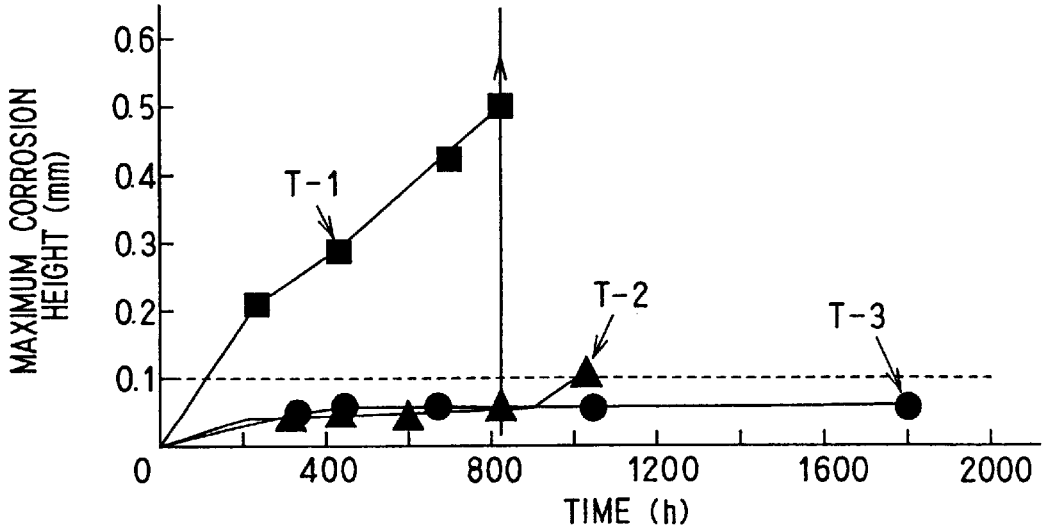
FIG. 10 is a graph showing results of tube corrosion tests using different materials, according to the first embodiment.

FIG. 10 shows the corrosion test due to condensed water. In FIG. 10, T-1 indicates a case where tubes of an evaporator are made aluminum material without the sacrifice corrosion layer and the tube plate thickness TT is set at 6 mm (i.e., TT=6 mm). In the T-1 test, when a thinned portion having the minimum thickness of 0.5 mm is formed by pressing, the maximum corrosion height (i.e., reduced thickness) becomes 0.5 mm for a test time of 800 hours, and a through hole is formed at the thinned portion.

In FIG. 10, T-2 indicates a case where tubes of an evaporator is formed by an aluminum plate in which the sacrifice corrosion layer having a thickness of 20 $\mu$m is provided and the tube plate thickness TT including the sacrifice corrosion layer is set at 0.10 mm (i.e., TT=0.10 mm). On the other hand, T-3 indicates a case where tubes of an evaporator is formed by an aluminum plate in which the sacrifice corrosion layer having a thickness of 40 $\mu$m is provided and the tube plate thickness TT including the sacrifice corrosion layer is 0.25 mm (i.e., TT=0.25 mm). In the test T-2 and the test T-3, the maximum corrosion height is 0.05 mm for the test time of 800 hours.

As described above, when the fin height FH is set in the range of 4.0–7.5 mm (i.e., 4.0 mm≦FH≦7.5 mm) and the tube plate thickness TT including the sacrifice corrosion layer is set in the range of 0.10–0.35 mm (i.e., 0.10 mm≦TT≦0.35 mm), the heat-conductive amount Q is increased while the pressure-resistance strength and corrosion-resistance performance of the tubes are improved. More particularly, by setting TT at a value equal to or smaller 0.35 mm (i.e., TT≦0.35 mm), the heat-conductive amount Q is further increased.

(3) TUBE HEIGHT (TH)

Figure 8:
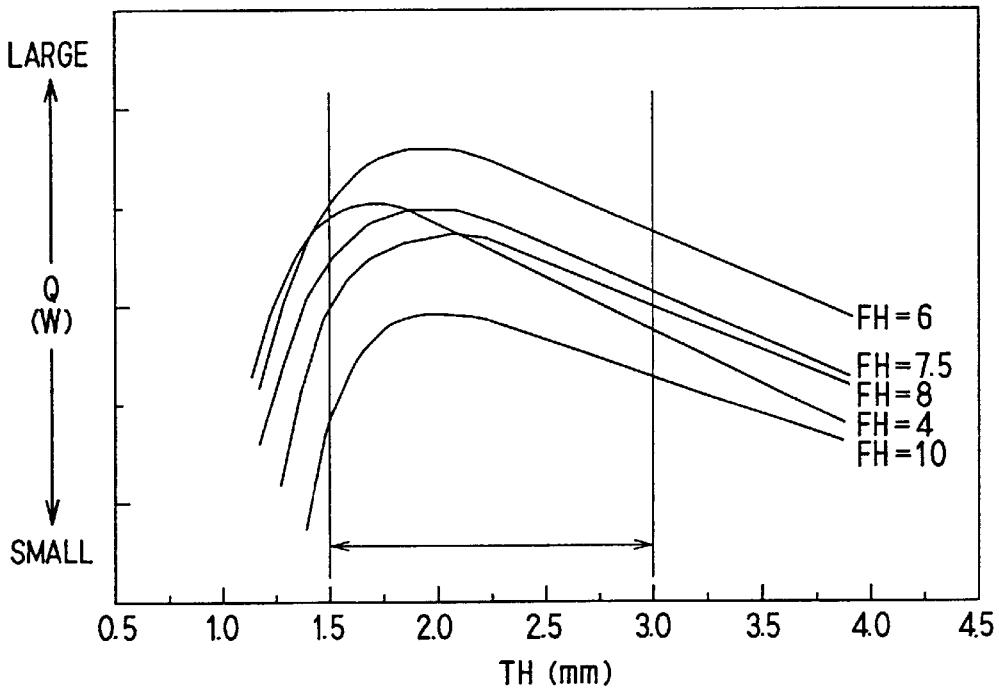
FIG. 8 is a characteristic view showing the relationship between the fin height FH, the tube height TH and the heat-conductive amount Q, according to the first embodiment.
Figure 9:
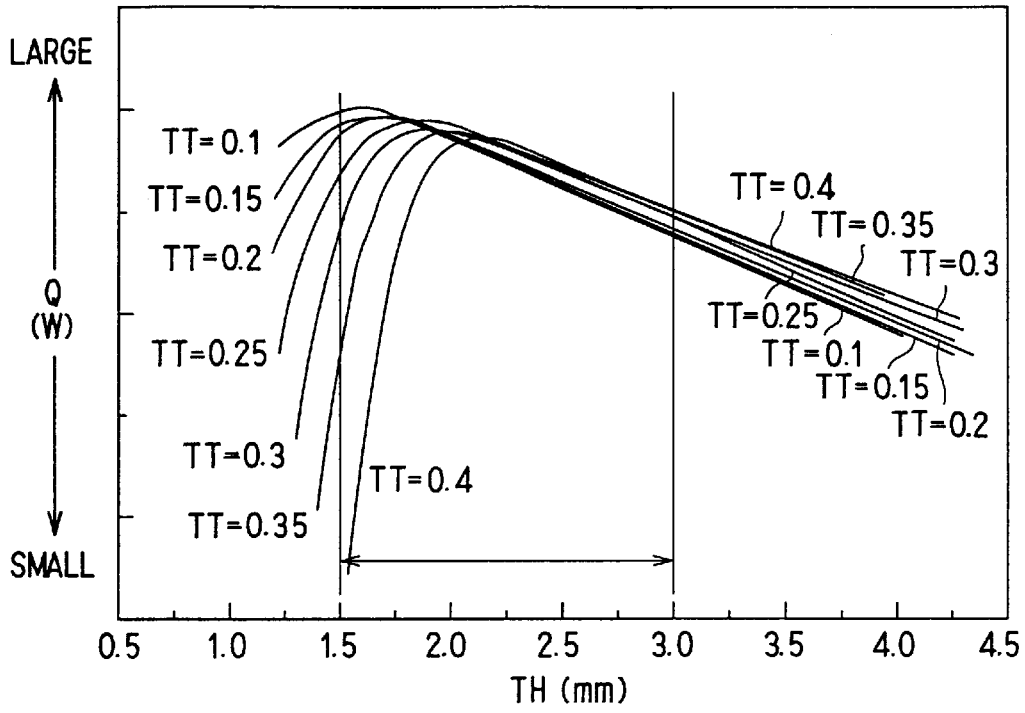
FIG. 9 is a characteristic view showing the relationship between the tube plate thickness TT, the tube height TH and the heat-conductive amount Q, according to the first embodiment.

FIGS. 8 and 9 shows the relationship between the tube height TH and the heat-conductive amount Q. First, in FIG. 8, the tube plate thickness TT is set at 0.25 mm (i.e., TT=0.25 mm), the fin pitch FP is set at 3.0 mm (i.e., FP=3.0 mm), and the core thickness D is set at 40 mm (i.e., D=40 mm). In this condition, the fin height FH is set at five different values in a range of 4–10 mm as shown in FIG. 8, and the heat-conductive amount Q(W) is calculated. As shown in FIG. 8, in the case where the fin height FH is in the range of 4.0–7.5 mm (i.e., 4.0 mm≦FH≦7.5 mm), when the tube height TH is set in a range of 1.5–3.0 mm (i.e., 1.5 mm≦TH≦3.0 mm), the heat-conductive amount Q becomes larger. When the tube height TH is set in a range of 1.5–2.5 mm (i.e., 1.5 mm≦TH≦2.5 mm), the heat-conductive amount Q is further increased.

In FIG. 9, the fin height FH is set at 6 mm (i.e., FH=6 mm), the fin pitch FP is set at 3.0 mm (i.e., FP=3.0 mm), and the core thickness D is set at 40 mm (i.e., D=40 mm). In this conditions, the tube plate thickness TT is set at seven different values in a range of 0.1–0.4 mm as shown in FIG. 9, and the heat-conductive amount Q(W) is calculated. As shown in FIG. 9, in a case where the tube plate thickness TT is in the range of 0.10–0.35 mm (i.e., 0.10 mm≦TT≦0.35 mm), when the tube height TH is set in a range of 1.5–3.0 mm (i.e., 1.5 mm≦TH≦3.0 mm), the heat-conductive amount Q becomes larger. When the tube height TH is set in a range of 1.5–2.5 mm (i.e., 1.5 mm≦TH≦2.5 mm), the heat-conductive amount Q is further increased.

Here, when the fin height FH is set in the range of 4.0–7.5 mm, the tube plate thickness TT is set in the range of 0.10–0.35 mm and the tube height TH is set in the range 1.5–3.0 mm, the heat-conductive amount Q of the evaporator 1 can be made maximum.

In FIGS. 8 and 9, when the tube plate thickness TT is set in the range of 0.10–0.35 mm, the heat conductive area at air side is increased while pressure loss of refrigerant in the refrigerant passage is prevented from being increased.

Therefore, in this case, the heat-conductive amount Q of the evaporator 1 is improved. However, when the tube height TH is set smaller than 1.5 mm, the sectional area of the refrigerant passage within the tube is reduced, and pressure loss of refrigerant in the refrigerant passage is increased. As a result, the heat-conductive amount Q is decreased. On the other hand, when the tube height TH is set larger than 3.0 mm, the heat conductive area at air side is reduced, and therefore, the heat-conductive amount Q of the evaporator 1 is decreased.

A second preferred embodiment of the present invention will be now described with reference to FIGS. 11–14.

In the above-described first embodiment, each of the tubes 2–5 is formed by bending an aluminum thin plate at a center to define a refrigerant passage having a flat sectional shape, and each inner refrigerant passage of the tubes 2–5 is partitioned into plural small passages by inner fins 20 provided inside the tubes 2–5. However, in the second embodiment, each flat tube 30 having plural refrigerant passage 32 is formed by extrusion using aluminum material.

Figure 11:
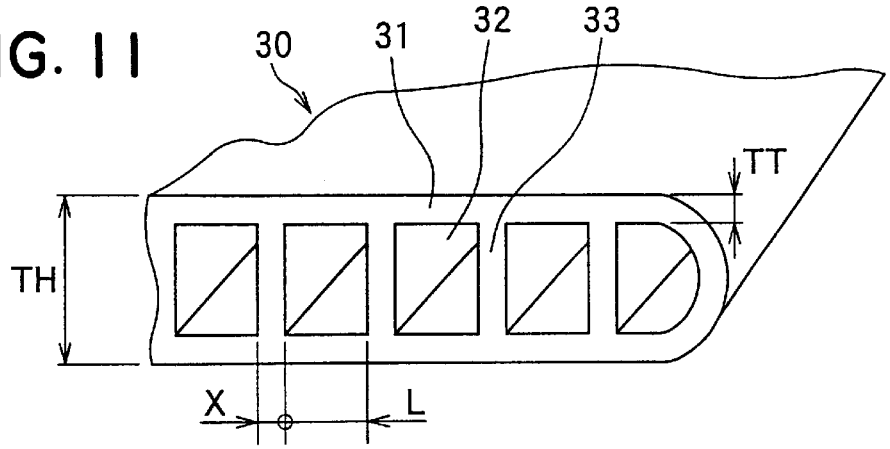
FIG. 11 is a perspective view showing a main part of a refrigerant evaporator according to a second preferred embodiment of the present invention.

As shown in FIG. 11, plural refrigerant passages 32 are formed to be arranged in line in a major direction of a flat cross section. Therefore, the plural refrigerant passages 32 extend in the tube longitudinal direction to be arranged in parallel. The plural refrigerant passages 32 are partitioned from each other by plural supports 33. Similarly to the first embodiment, the plural tubes 30 are laminated through corrugated fins each of which is disposed between adjacent tubes 30. In the second embodiment, the inner fins 20 described in the first embodiment are not necessary.

Next, computer simulation relative to strength of the tubes 30 and the heat-conductive amount Q (W) is performed in a refrigerant evaporator using the flat tubes 30.

Figure 12:
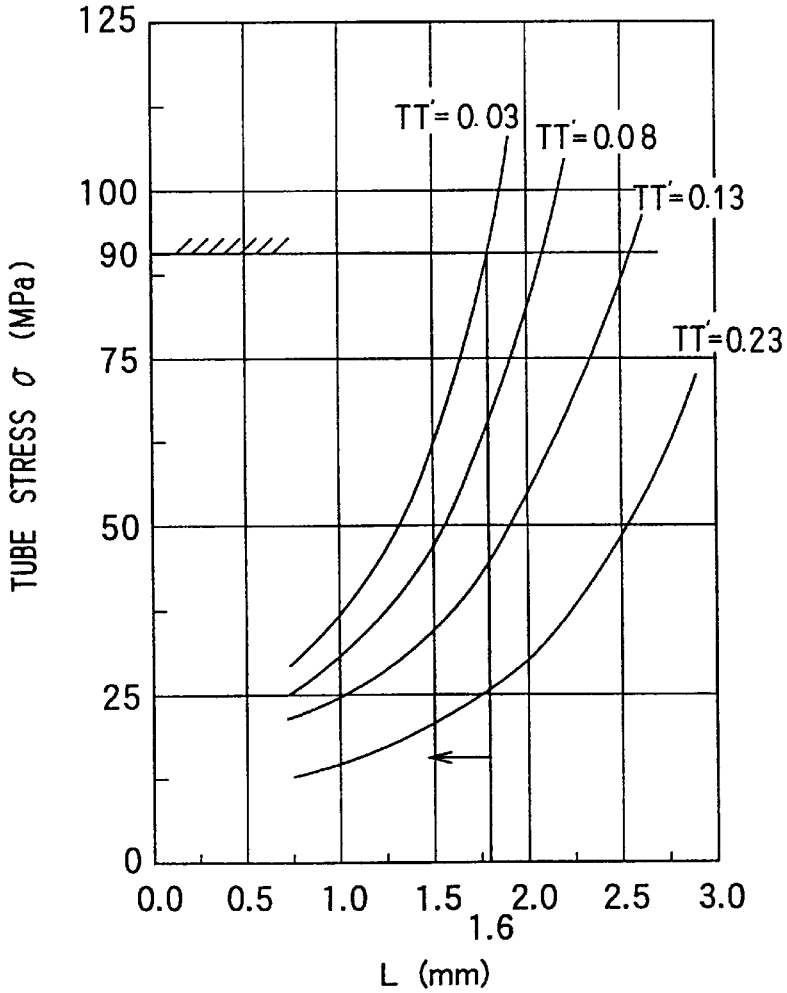
FIG. 12 is a characteristic view showing the relationship between a tube plate thickness TT, a distance L between adjacent tube supports and a tube stress σ, according to the second embodiment.

First, the strength of the tube 30 is described. FIG. 12 is a graph showing the relationship between a distance L of adjacent supports 33 and maximum tube stress σ generated in the tube 30. As the simulation conditions, the fin height FH is set at 1.7 mm (i.e., FH=1.7 mm), the support plate thickness ST of each support 33 is set at 0.2 mm, and the maximum load pressure (inner pressure) of the tube 30 is set at 10 kg/cm$^2$ when the evaporator is actually used for a vehicle.

In the second embodiment, after the tube 30 is formed by extrusion using an aluminum material (e.g., A1000), a sacrifice corrosion material such as melted zinc is applied onto the outer surface of an outer wall portion 31 of the tube 30 so that the sacrifice corrosion layer having a high corrosion resistance is provided in the tube 30. In this case, the zinc distribution height is approximately 0.12 mm, and is sufficiently used for an actual corrosion height. In the simulation, when the corrosion degree (corrosion maximum height) is set at 0.12 mm when the evaporator is used for predetermined resistance years, a tube plate thickness TT' after using is set at four values in a range of 0.03–0.23 mm which are subtracted values of the corrosion degree 0.12 mm from the initial tube plate thickness TT of 0.15–0.35 mm.

As shown in FIG. 12, because the extrusion strength applied to the tube 30 during the extrusion is approximately 90 MPa, it is necessary to set the distance L between adjacent supports 33 is set at a value equal to or smaller than 1.6 mm for maintaining pressure-resistance strength of the tubes 30 after the predetermined resistance years, when the initial tube plate thickness TT is set in the range of 0.15–0.35 mm.

Figure 13:
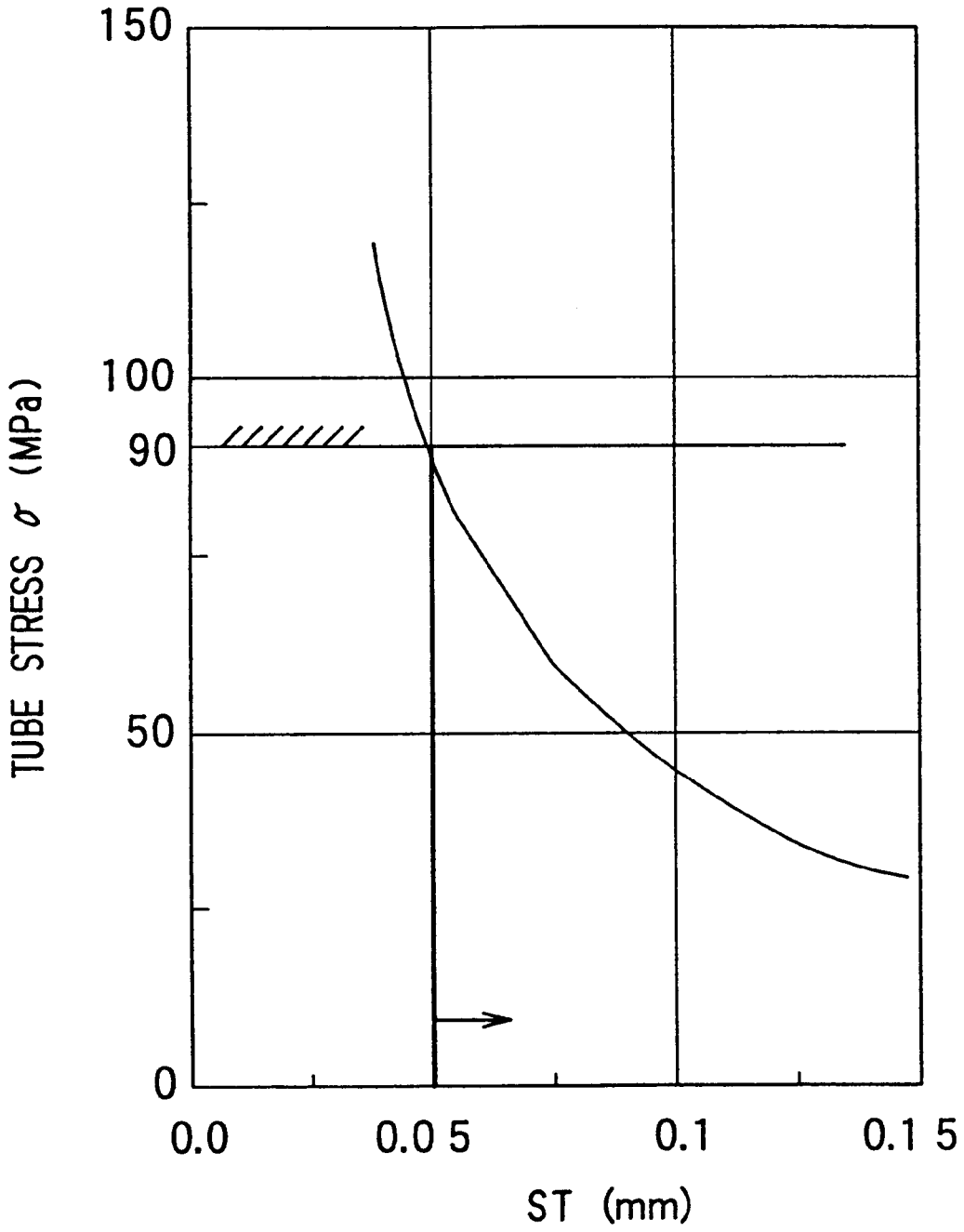
FIG. 13 is a characteristic view showing the relationship between a tube support thickness ST and the tube stress a according to the second embodiment.

FIG. 13 shows the relationship between the support plate thickness ST of the support 33 and the maximum tube stress σ generated in the tube 30. In FIG. 13, as the simulation conditions, the fin height FH is set at 1.7 mm (i.e., FH=1.7 mm), the tube plate thickness TT is set at 0.35 mm (i.e., TT=0.35 mm), the distance L between adjacent supports 33 is set at 1.2 mm (i.e., L=1.2 mm), and inner pressure of the tube 30 is set at 27 kg/cm$^2$. The inner pressure is the breaking pressure of an inner receiver using R134*a*, which is defined in JIS. As shown in FIG. 13, for obtaining the initial breaking strength, the plate thickness ST of the support 33 is necessary to be equal to or larger than 0.05 mm (i.e., ST≧0.05 mm).

Figure 14:
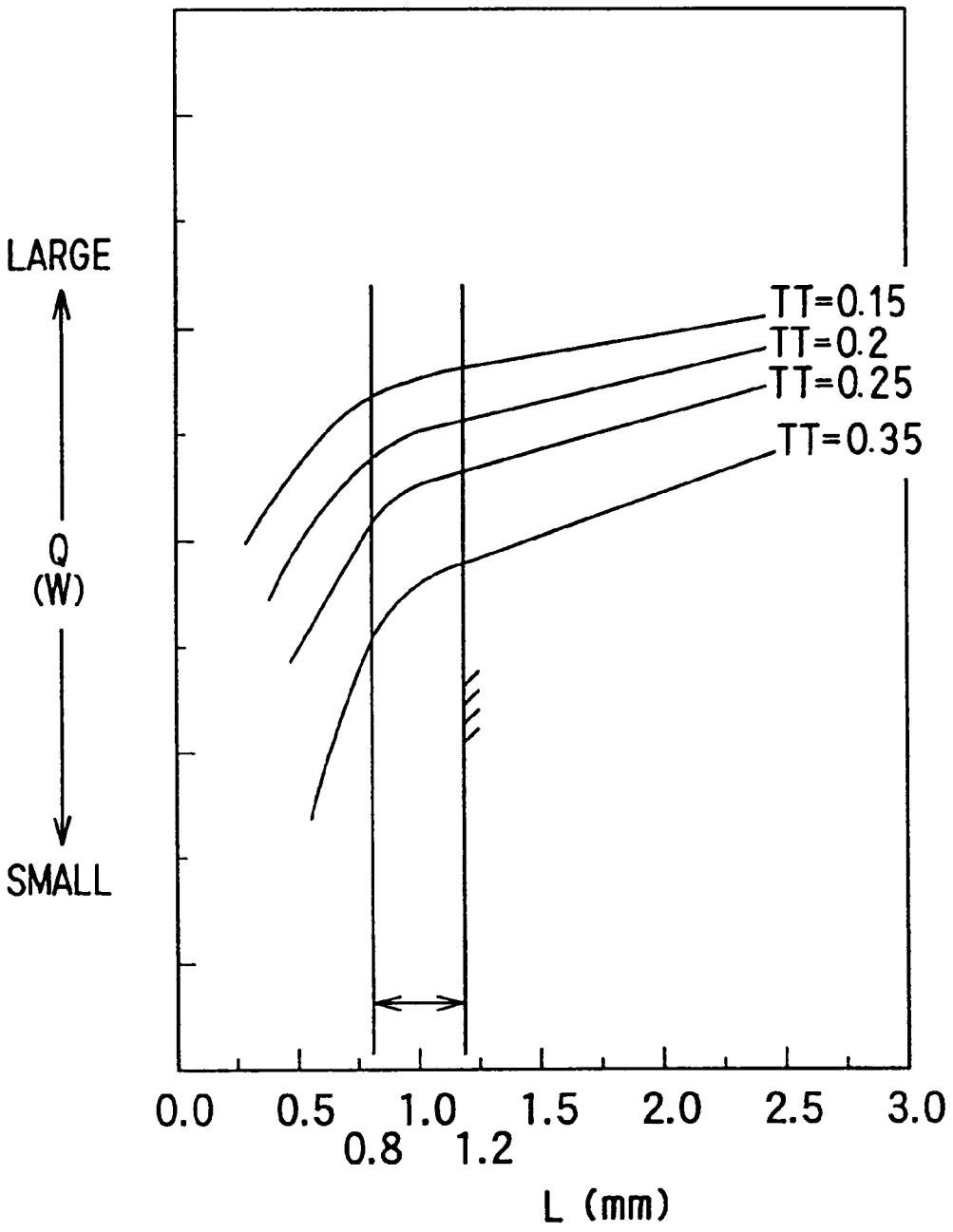
FIG. 14 is a characteristic view showing the relationship between the tube plate thickness TT, the distance L and the heat-conductive amount Q, according to the second embodiment.

FIG. 14 shows the relationship between the distance L of the adjacent supports 33 and the heat-conductive amount Q(W). In FIG. 14, as the simulation conditions, the core height H is set at 215 mm, the core width W is set at 300 mm, the fin thickness FT is set at 0.07 mm, the pulse number is set at 4, the tube height TH is set at 1.7 mm, the fin pitch FP is set at 3.0 mm, the core thickness D is set at 40 mm, the support plate thickness ST is set at 0.2 mm, and the tube plate thickness TT is set at four different values in a range of 0.15–0.35 mm.

Further, the temperature, the humidity and the amount of air flowing into the core portion of the evaporator are set at constant values, and the temperature and the pressure of refrigerant flowing into the inlet of the evaporator is set at constant values. In the evaporator, because the heat-conductive percentage is greatly relative to adhesion of condensed water on the corrugated fins, the heat-conductive amount Q is calculated to be relative to the condensed water.

As shown in FIG. 14, when the distance L between adjacent supports becomes smaller than 0.8 mm, the heat-conductive amount Q is rapidly decreased. In this case, because the number of the supports 33 are increased, the sectional area of the refrigerant passage is reduced, and pressure loss of refrigerant in the refrigerant passage is increased. Therefore, for improving the heat-conductive performance of the evaporator, the distance L between the adjacent supports 33 is set at a value equal to or larger than 0.8 mm (i.e., L≧0.8 mm).

In the evaporator having the tubes 30, when the distance L between adjacent supports 33 is set at a value equal to or larger than 0.8 mm when the tube plate thickness TT is set in a range of 0.15–0.3 mm and the tube height TH is set in a range of 1.5–3.0 mm, the pressure loss of the refrigerant passage is made smaller and the heat exchanging area at air side is made larger. As a result, the heat-conductive performance of the evaporator is improved. Further, when the support plate thickness ST is set at a value equal to or larger than 0.05 mm (i.e., ST≧0.05 mm) and the distance L between adjacent supports 33 is set at a value equal to or smaller than 1.6 mm (i.e., L≦1.6 mm), the pressure-resistance strength of the tube 30 is improved. Here, in the evaporator using the tubes 30, both the pressure-resistance strength and heat-conductive performance are improved.

Further, by setting the fin height FH in the range of 4.0–7.0 mm (i.e., 4.0 mm≦FH≦7.5 mm), the fin effect can be made higher while a decrease of heat-conductive percentage due to condensed water is restricted. As a result, the heat-conductive amount Q of the evaporator further becomes larger.

Although the present invention has been fully described in connection with the preferred embodiments thereof with reference to the accompanying drawings, it is to be noted that various changes and modifications will become apparent to those skilled in the art.

For example, in the above-described embodiments, the tubes 2–5, 30 and the tank portions 8–13 are connected through brazing after being respectively separately formed. However, the present invention may be applied to a refrigerant evaporator formed by laminating plural pairs of plates, each of which is formed by connecting both plates to form a refrigerant passage of a tube and a tank portion therein.

Further, in the above-described first embodiment, the tubes 2–5 are arranged in two rows in the air flowing direction A, and the tank portions 8–13 are also arranged in two rows in the air flowing direction A to correspond to the arrangement of the tubes 2–5. However, the present invention may be applied to a refrigerant evaporator in which the tubes are arranged in a single line or plural lines more than three. When the tubes are arranged in the plural lines more than three, the suitable selection effect of the above-described dimensions of an evaporator becomes remarkable. Further, the present invention may be applied to an evaporator having plural passages different from 4-passes described above.

Such changes and modifications are to be understood as being within the scope of the present invention as defined by the appended claims.

What is claimed is:

1. An evaporator for performing heat exchange between refrigerant and air, comprising:

a plurality of tubes through which refrigerant flows, the tubes being made of an aluminum material and being arranged in parallel with each other in a laminating direction perpendicular to a flow direction of air; and a plurality of corrugated fins made of an aluminum material, each of which is disposed between adjacent tubes to increase a heat-conductive area of air passing through between the tubes, wherein:

the tubes have a tube plate thickness TT being in a range of 0.10 mm–0.35 mm; and each of the tubes has a tube height TH in the laminating direction, the tube height TH being in a range of 1.5 mm–3.0 mm.

2. The evaporator according to claim 1, wherein each of the corrugated fins has a fin height FH in the laminating direction, the fin height FH being in a range of 4.0 mm–7.5 mm.

3. The evaporator according to claim 1, wherein the aluminum material for forming the tubes has a sacrifice corrosion layer on an outer surface.

4. The evaporator according to claim 1, wherein the tubes are arranged in plural rows in the flow direction of air.

5. The evaporator according to claim 4, wherein:

the tubes and the corrugated fins define a core portion;

the core portion has a thickness D in the flow direction of air; and the thickness D of the core portion is equal to or smaller than 50 mm.

6. The evaporator according to claim 1, further comprising a tank for distributing refrigerant into the tubes and for collecting refrigerant from the tubes, the tank being disposed at both ends of each tube.

7. The evaporator according to claim 1, further comprising inner fins disposed inside the tubes, for increasing heat-conductive area of refrigerant flowing through the tubes.

8. The evaporator according to claim 1, wherein:

each of the tubes has an outer wall portion formed into a flat cross section for defining an inner space therein, and plural supports for partitioning the inner space into plural refrigerant passages; and each of the tubes is formed by extrusion.

9. An evaporator for performing heat exchange between refrigerant and air, comprising:

a plurality of tubes through which refrigerant flows, the tubes being made of an aluminum material and being arranged in parallel with each other in a laminating direction perpendicular to a flow direction of air; and a plurality of corrugated fins made of an aluminum material, each of which is disposed between adjacent tubes to increase a heat-conductive area of air passing through between the tubes, wherein each of the corrugated fins has a fin height FH in the laminating direction, the fin height FH being in a range of 4.0 mm–7.5 mm.

10. The evaporator according to claim 9, wherein the tubes have a tube plate thickness TT being in a range of 0.10 mm–0.35 mm.

11. The evaporator according to claim 9, wherein each of the tubes has a tube height TH in the laminating direction, the tube height TH being in a range of 1.5 mm–3.0 mm.

12. The evaporator according to claim 9, wherein the tubes are arranged in plural rows in the flow direction of air.

13. The evaporator according to claim 12, wherein:

the tubes and the corrugated fins define a core portion;

the core portion has a thickness D in the flow direction of air; and the thickness D of the core portion is equal to or smaller than 50 mm.

14. The evaporator according to claim 9, further comprising inner fins disposed inside the tubes, for increasing heat-conductive area of refrigerant flowing through the tubes.

15. The evaporator according to claim 9, wherein:

each of the tubes has an outer wall portion formed into a flat cross section for defining an inner space therein, and plural supports for partitioning the inner space into plural refrigerant passages; and each of the tubes is formed by extrusion.

16. An evaporator for performing heat exchange between refrigerant and air, comprising:

a plurality of tubes through which refrigerant flows, the tubes being made of an aluminum material and being arranged in parallel with each other in a laminating direction perpendicular to a flow direction of air; and a plurality of corrugated fins made of an aluminum material, each of which is disposed between adjacent tubes to increase a heat-conductive area of air passing through between the tubes, wherein:

each of the tubes has an outer wall portion formed into a flat cross section for defining an inner space therein, and plural supports for partitioning the inner space into plural refrigerant passages;

the outer wall portion has a plate thickness being in a range of 0.15 mm–0.35 mm;

each of the tubes has a tube height TH in the laminating direction, the tube height TH being in a range of 1.5 mm–3.0 mm;

each of the supports has a plate thickness ST equal to or larger than 0.05 mm; and a distance L between adjacent supports is in a range of 0.8 mm–1.6 mm.

17. The evaporator according to claim 16, wherein each of the corrugated fins has a fin height FH in the laminating direction, the fin height FH being in a range of 4.0 mm–7.5 mm.

18. The evaporator according to claim 16, wherein the aluminum material for forming the tubes has a sacrifice corrosion layer on an outer surface.

19. The evaporator according to claim 16, wherein the tubes are arranged in plural rows in the flow direction of air.

20. The evaporator according to claim 19, wherein:

the tubes and the corrugated fins define a core portion;

the core portion has a thickness D in the flow direction of air; and the thickness D of the core portion is equal to or smaller than 50 mm.

* * * * *